US005917526A

United States Patent [19]

Wilson et al.

[11] Patent Number: 5,917,526

[45] Date of Patent: Jun. 29, 1999

[54] METHOD AND APPARATUS FOR INK CONTAINER LOCKING

[75] Inventors: Rhonda L. Wilson, Monmouth, Oreg.; Richard H. Lewis, Barcelona, Spain

[73] Assignee: Hewlett-Packard Company, Palo Alto, Calif.

[21] Appl. No.: 08/839,011

[22] Filed: Apr. 23, 1997

[51] Int. Cl.[6] ..... B41J 2/175

[52] U.S. Cl. ..... 347/86

[58] Field of Search ..... 347/85, 86, 87, 347/49

[56] References Cited

U.S. PATENT DOCUMENTS

| | | | |
|---|---|---|---|
| 4,558,326 | 12/1985 | Kimura et al. | 347/30 |
| 4,568,954 | 2/1986 | Rosback | 347/86 |
| 5,307,091 | 4/1994 | DeCoste, Jr. | 347/86 |

FOREIGN PATENT DOCUMENTS

| | | | |
|---|---|---|---|
| 0419876 | 4/1991 | European Pat. Off. | B41J 2/005 |
| 92 03 206 | 5/1992 | Germany | B41J 2/175 |

*Primary Examiner*—N. Le
*Assistant Examiner*—Michael Nghiem
*Attorney, Agent, or Firm*—Kevin B. Sullivan

[57] ABSTRACT

The present invention is an ink container for providing ink to an ink-jet printer. The ink container includes an inlet configured for connection to a pressurization source. The ink container also includes an expandable outer shell configured for expansion upon activation of the pressurization source. The expandable outer shell has an engagement feature that is configured for engagement with a corresponding engagement feature associated with the ink-jet printer. The expandable outer shell has an unexpanded position allowing removal of the ink container from the ink-jet printer and an expanded position wherein the outer shell engagement feature engages with the engagement feature associated with the ink-jet printer to resist removal of the ink container from the ink-jet printer.

22 Claims, 4 Drawing Sheets

SECTION 4-4'

METHOD AND APPARATUS FOR INK CONTAINER LOCKING

BACKGROUND OF THE INVENTION

The present invention relates to ink-jet printing systems, and more particularly, ink-jet printing systems which make use of ink containers that are replaceable separate from a printhead.

Ink-jet printers frequently make use of an ink-jet printhead mounted to a carriage which is moved back and fourth across a print media, such as paper. As the printhead is moved across the print media, a control system activates the printhead to eject or jet ink droplets onto the print media to form images and text.

Previously used printers have made use of an ink container that is separably replaceable from the printhead. When the ink cartridge is exhausted the ink cartridge is removed and replaced with a new ink container. The use of replaceable ink containers that are separate from the printhead allow users to replace the ink container without replacing the printhead. The printhead is then replaced at or near the end of printhead life and not when the ink container is exhausted.

One type of replaceable ink container is disclosed in U.S. Pat. No. 4,558,326 entitled "Purging System for Ink Jet Recording Apparatus" to Kimura et al. discloses the use of a replaceable ink cartridge having a hermetically sealed ink container bag disposed therein. The ink container bag in Kimura is in fluid communication with a recording head. Kimura makes use of the selective application of compressed air to the ink cartridge for pressurizing the ink container bag for forcing ink through the recording head thereby purging bubbles or solid matter from the ink flow path. When the purging of bubbles and solid matter is complete, the source of pressurized air is removed from the cartridge body and the cartridge body is vented to atmospheric pressure. After purging is complete, the recording apparatus in Kimura is operated with the source of pressurized air removed from the cartridge body.

There is an ever present need for ink containment systems that are capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead. An interruption in the flow of ink to the printhead during operation of the printhead can result in excessive heating of the printhead. Operating the printhead without ink can result in catastrophic failure of the printhead or a reduction in printhead life.

Additionally, these ink supplies should be capable of operating over a wide range of environmental conditions, such as atmospheric pressures and changes in atmospheric pressures. These ink supplies should also be transportable over a wide range of environmental conditions without effecting the integrity or reliability of the ink supply. For example, the ink supply should be capable of withstanding rapid changes in atmospheric pressure without a reduction in reliability or reduction in the integrity of the ink container.

Finally, the ink supply should be easily replaceable as well as form reliable fluid connection with the printing device while minimizing or eliminating ink spillage which can reduce the reliability of the printing device.

SUMMARY OF THE INVENTION

The present invention is an ink container for providing ink to an ink-jet printer. The ink container includes an inlet configured for connection to a pressurization source. The ink container also includes an expandable outer shell configured for expansion upon activation of the pressurization source. The expandable outer shell has an engagement feature that is configured for engagement with a corresponding engagement feature associated with the ink-jet printer. The expandable outer shell has an unexpanded position allowing removal of the ink container from the ink-jet printer and an expanded position wherein the outer shell engagement feature engages with the engagement feature associated with the ink-jet printer to resist removal of the ink container from the ink-jet printer.

In one preferred embodiment the engagement feature associated with the expandable outer shell is a raised portion on an outer surface of the expandable outer shell. In this preferred embodiment the engagement feature associated with the ink-jet printer is a recessed portion on the ink-jet printer. The expandable outer shell has an expanded position in which the raised portion extends into the recessed portion to resist removal of the ink container from the ink-jet printer.

DETAILED DESCRIPTION OF THE PREFERRED EMBODIMENT

Figure 1:
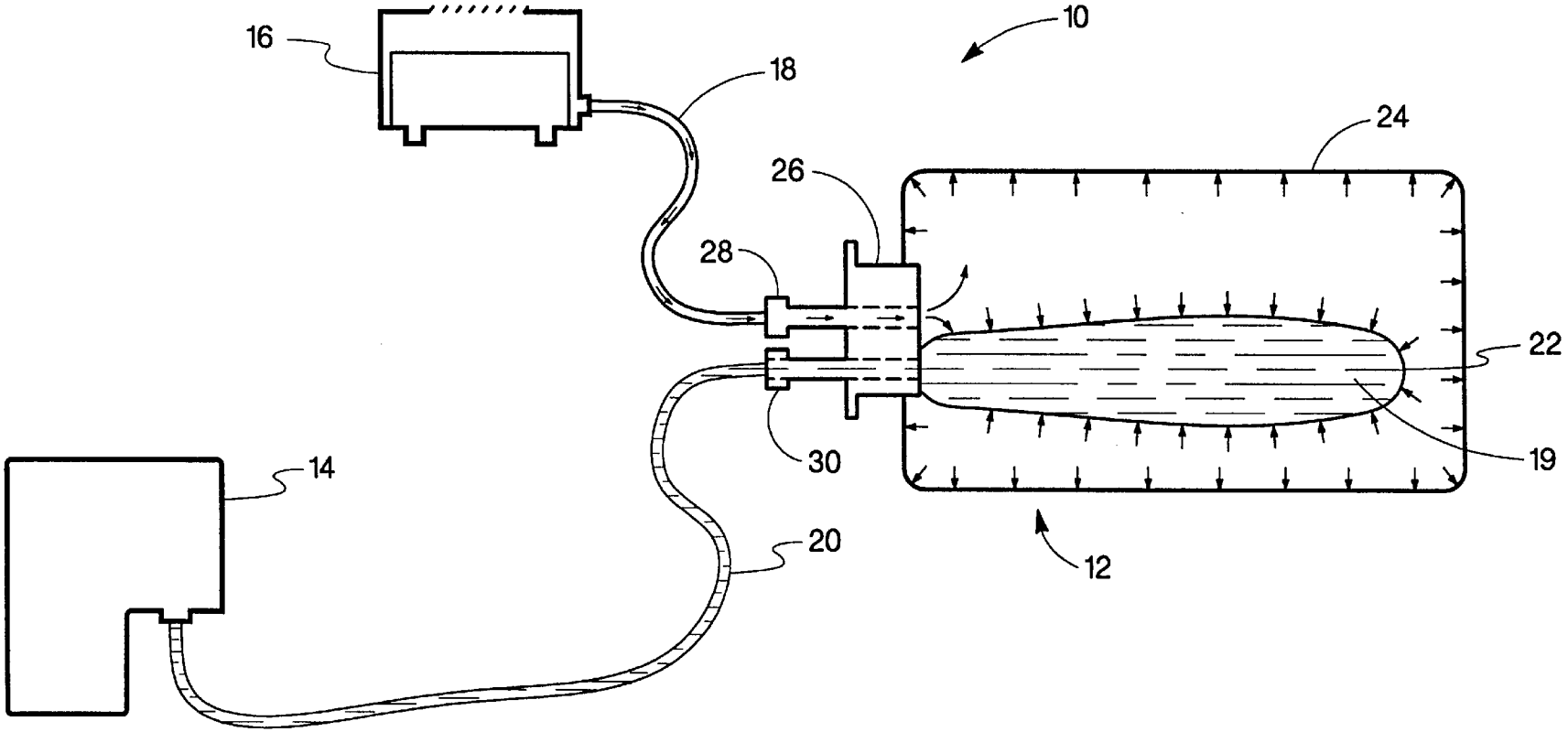
FIG. 1 depicts a schematic representation of a printing system that includes an ink container of the present invention.

FIG. 1 depicts a schematic representation of a printing system 10 which includes the ink container 12 of the present invention. Also included in the printing device 10 is a printhead 14 and a pump 16. The pump 16 is connected by a conduit 18 for providing pressurized gas to the ink container 12. A marking fluid, such as ink 19, is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a sealing portion or cap 26. In the preferred embodiment the cap 26 includes a gas interconnect 28 configured for connection to conduit 18 for pressurizing the outer shell 24 with gas. A fluid interconnect 30 is also included in the cap 26. The fluid interconnect 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

Figure 2:
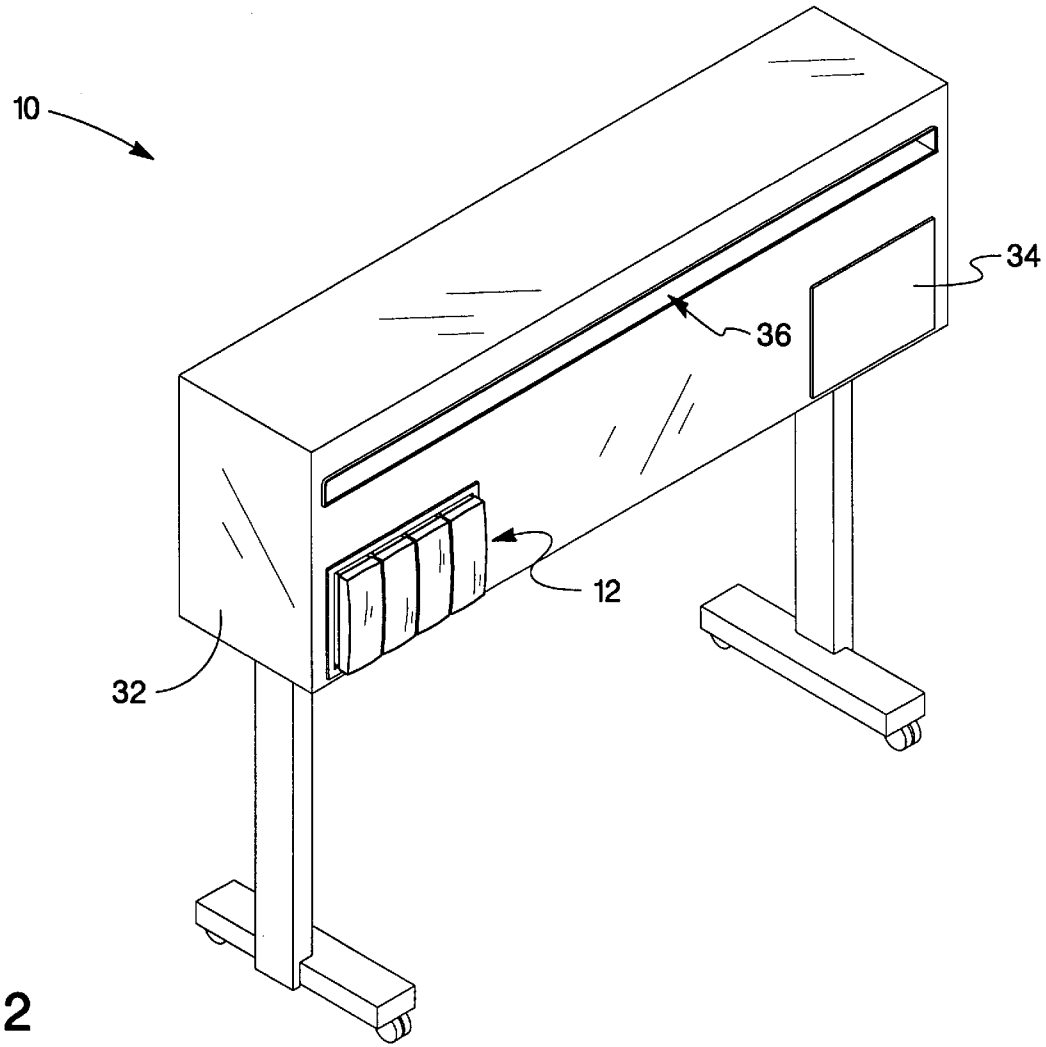
FIG. 2 depicts a perspective view of a representation of the printing system of FIG. 1.

FIG. 2 depicts one embodiment of the printing system 10 shown in perspective. The printing system 10 includes a printing housing or printer chassis 32 containing one or more ink containers 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 32 is a control panel 34 for controlling operation of the printer 10 and a media slot 36 from which print media such as paper is ejected.

As ink 19 in each ink container 12 is exhausted the ink container 12 is replaced with a new ink container 12 containing a supply of ink. In addition the ink container 12 may be removed from the printer chassis 32 for reasons other than an out of ink condition such as changing inks for an application requiring different ink properties or for use on different media. It is important that the ink container 12 is not removed during certain events such as when the printer is operating or when the ink container 12 is pressurized. Removal of the ink container 12 during operation of the printing system 10 can result in improper cooling of the printhead. Thermal printheads often require ink flow through the printhead during printing to maintain printhead temperatures within an operating temperature range. If the flow of ink 19 through the printhead is interrupted by the removal of the ink container 12, then the proper operating range may not be achievable resulting in overheating of the printhead. This overheating, if sufficient, can result in catastrophic failure of the printhead.

In the case of pressurized ink delivery systems such as show in FIG. 1 it is important that the ink container 12 not be removed from the printer chassis 32 when the container is pressurized. Removal of a pressurized ink container 12 can result in ink splattering or spilling from the fluid interconnect 30. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

The present invention, as will be described with respect to the embodiments shown in FIGS. 3A and 3B and 4A and 4B, is directed to a locking method and apparatus for selectively preventing or resisting the removal of the ink container 12 from the printer housing or chassis 32. By selectively preventing the removal of the ink container 12 problems such as operation of the printhead without ink and ink spilling or splattering, to name a few, can be reduced or eliminated.

Figures 3A, 3B:
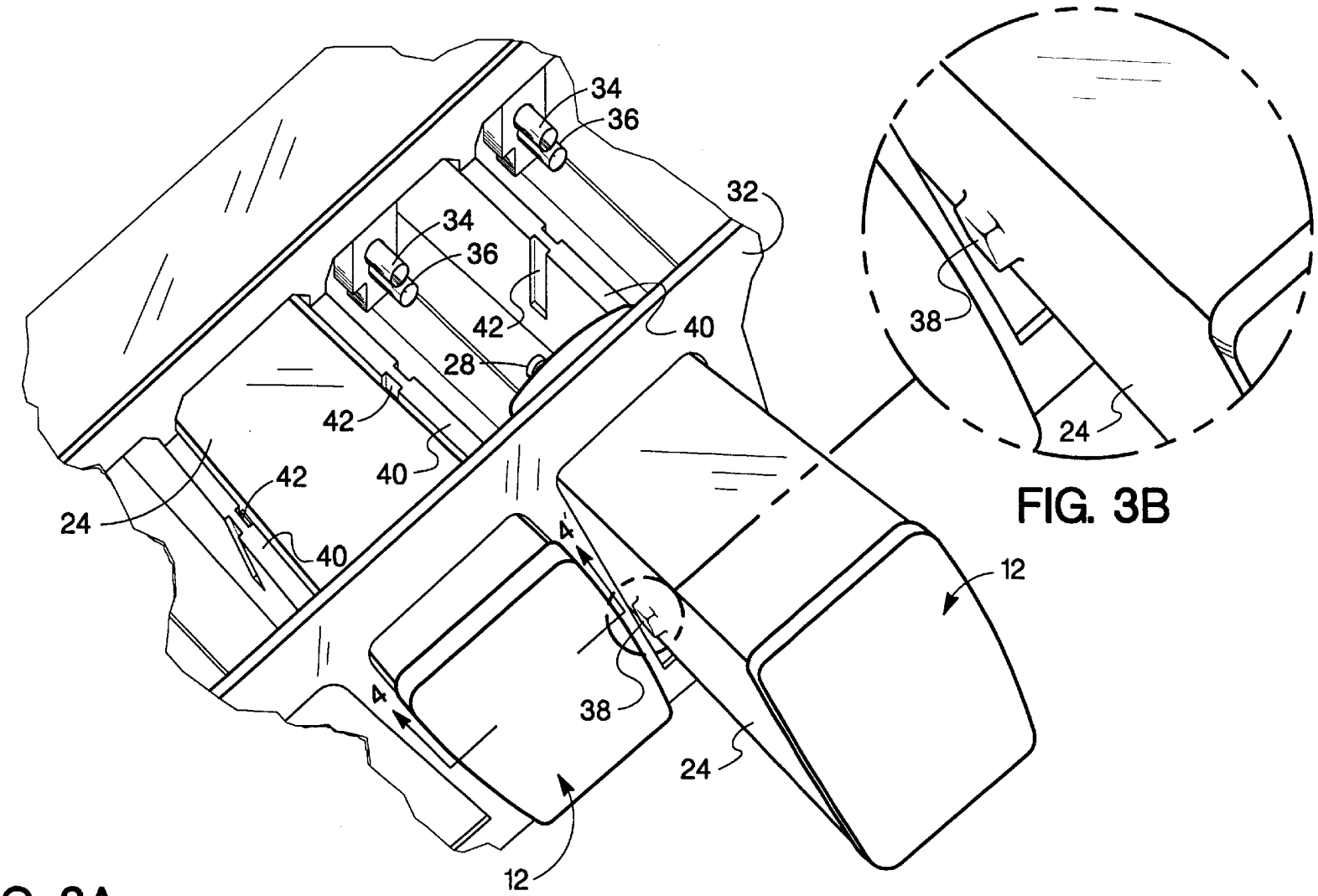
FIGS. 3A and 3B depict the ink container of the present invention shown greatly enlarged with a printer portion partially broken away.

FIGS. 3A and 3B depict an ink container 12 of the present invention which includes locking features of the present invention for selectively resisting or preventing removal of the ink container 12 from the printer chassis 32. Because both ink containers are similar, except for the color of ink contained within their respective fluid reservoir, the same reference numbering will be used for each ink container 12. The ink containers 12 include an outer shell 24 having an outer surface thereon. Also included on each ink container 12 is an air interconnect 28 and a fluid interconnect 30 (not shown) which are configured for connection to a corresponding air and fluid interconnects 34 and 36, respectively associated with the printer chassis 32. With the ink container 12 properly inserted into the printer chassis 32 the air interconnect 28 and fluid interconnect 30 associated with the ink container 12 engage with corresponding fluid and air interconnects 34 and 36, respectively, associated with the printer chassis 32. Proper insertion of the ink container 12 into the printer chassis 32 establishes communication between the printhead 14 and the fluid reservoir 22 and establishes communication between the inner portion of outer shell 24 and the pump 16.

An important feature of the present invention is an engagement feature or raised portion 38 shown on the outer surface of outer shell 24. In the preferred embodiment the raised portion 38 is positioned on opposite sides of the outer shell 24 of ink container 12. With the ink container 12 properly inserted into the printer chassis 32 sidewalls 40 associated with the printer chassis 32 have a corresponding engagement feature 42. In one preferred embodiment the engagement feature 42 is a depression or recessed portion which is properly aligned with the raised portion 38 on the ink container 12.

Figure 4B:
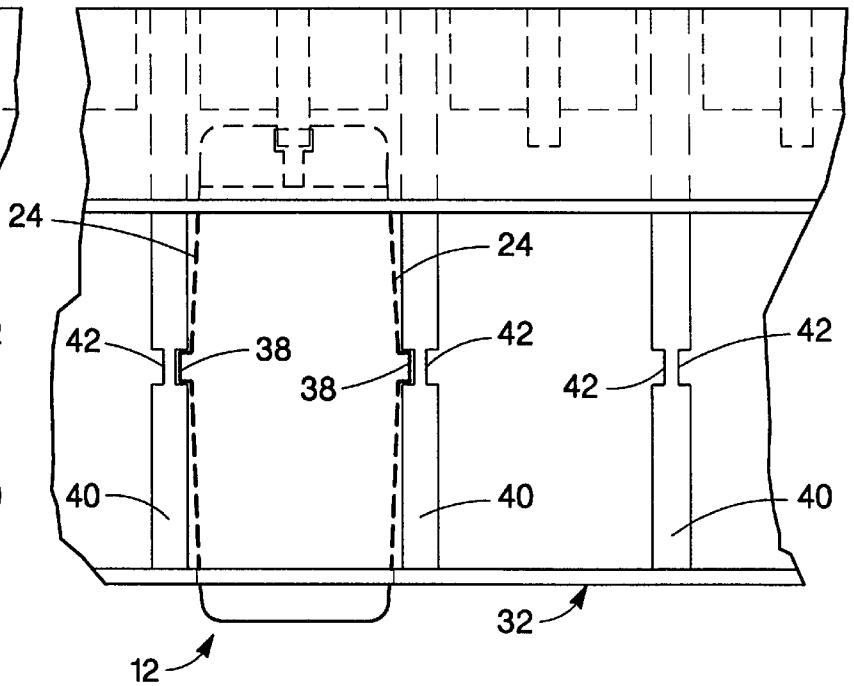
FIGS. 4A and 4B depicts the ink container of FIGS. 3A and 3B shown in section taken across line 4–4' with the ink container in an unexpanded position and in an expanded position.
Figure 4A:
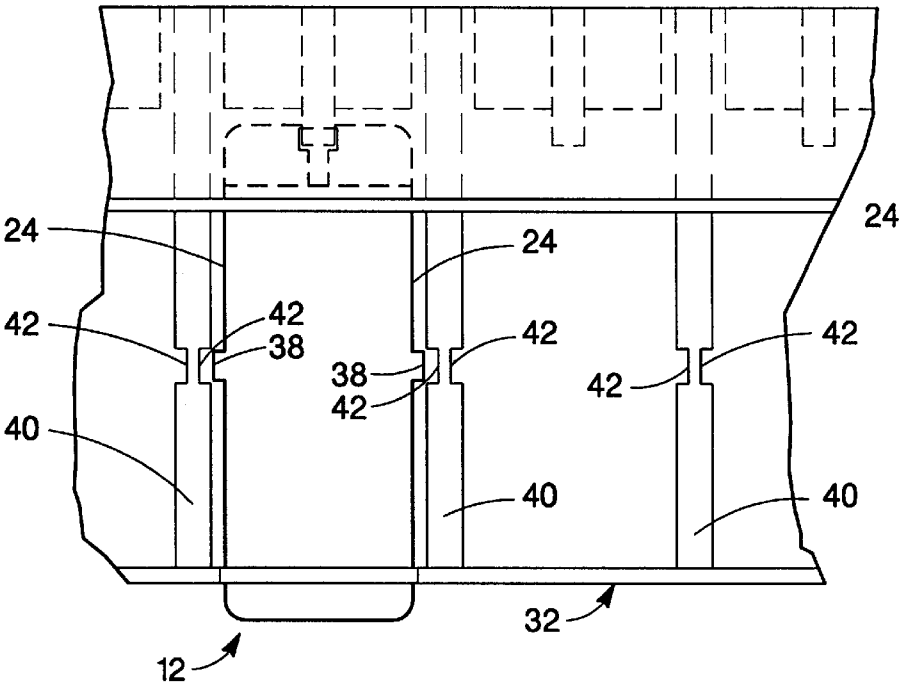

FIGS. 4A and 4B represent a sectional view taken through lines 4–4' which passes through the raised portion 38 to better show the alignment of raised portions 38 and depressions or recessed portions 42. It can be seen from FIG. 4A that the walls 40 on either side of the ink container 12 are spaced to provide sufficient tolerance for insertion and removal of the ink container 12 from the printer chassis 32. Therefore, when an ink container 12 is either empty or an ink change is required the ink container 12 can be removed from the printer chassis 32 and a new ink container 12 inserted.

FIG. 4B shows the ink container 12 with the outer shell 24 represented by dotted lines in an expanded position. The outer shell 24 of ink container 12 is expanded by providing pressurized gas from pump 16 to the ink container 12. This pressurized gas produces an expansion of the ink container 12. Upon expansion of the ink container 12 the outer shell 24 expands or is displaced furthest at the weakest structural portion of the ink container 12. Placement of the raised portion 38 at or near the weakest structural portion maximizes the displacement of the raised portion 38. This arrangement allows for effective interlocking between the raised portion 38 and the recessed portion 42 in the pressurized state while maximizing the distance between the raised potion 38 and the recessed portion 42 in the non-pressurized state. This in turn provides for maximum tolerance between the ink container 12 and the printer chassis 32. Maximizing this tolerance reduces the manufacturing costs of both the ink container 12 and the printer chassis 32.

The ink container 12 is pressurized by pump 16 to expand the ink container 12 to lock the ink container 12 within the printer chassis 32. One example of the use of this expansion lock of the present invention is during the printing operation to prevent removal of the ink container 12 which can result in printhead damage. For the ink supply system shown in FIG. 1 the pressurization of the ink container 12 in addition to expanding the walls of the ink container 12 to prevent removal of the ink container 12 also pressurizes the fluid reservoir 22 for providing a pressurized ink supply to the printhead 14.

It is important that during the printing operation the ink container 12 is not removed from the printer chassis 32. Removal of the ink container 12 during the printing operation may result in activation of the printhead without a supply of ink within the printhead sometimes referred to as "dry firing". Operation of the printhead without a proper supply of ink can result in a catastrophic failure of the printhead, or reduction in printhead life or a reduction in reliability of the printhead.

In addition, removal of the ink container 12 from the printer while the printer is in operation could result in the removal of a pressurized ink container. This ink container when left in a pressurized state for a long period of time without any structural support such as that provided by walls 40 of the printer chassis 32 may result in damage to the ink container 12. Pressurization of the ink container 12 over an extended period of time can result in the permanent deformation of the ink container 12. For this reason, it is desirable that the removal of the ink containers 12 from the printer chassis 32 be resisted or prevented when pressurized.

The present invention requires only that the ink container 12 which expands when pressurized and that the expanded outer surface 24 engage the walls 40 within the printer chassis 32. It is the friction of the outer surface 24 and the walls 40 which prevent or resist removal of the ink container 12 in the expanded position. To provide greater removal resistance raised portions 38 can be provided on the ink container outer surface 24 as well as corresponding recesses 42 in the inner walls 42 of the printer chassis 32. It is the engagement of the raised portions 38 associated with the ink container 12 and the recessed portions 42 associated with the printer chassis 32 that provided added resistance to prevent or resist the removal of the ink container 12 when pressurized.

The amount of resistance to removal of the ink container 12 from the printer chassis 32 depends on the stiffness of the outer shell 24, the orientation of the engagement portion relative to the direction of removal and the area of engagement between the raised portion 38 and the recessed portion 42 associated with the printer chassis 32. In the preferred embodiment the outer shell 24 is made from high-density polyethylene (HDPE) the thickness of the walls of the outer shell as well as the dimensions of the ink container 12 will effect the degree of outer shell expansion. In addition, extending the raised portion 38 along the outer shell 24 of the ink container 12 or using a larger number of raised portions 38 on the ink container 12 together with corresponding recessed portions 42 can be used to increase the resistance to removal of the ink container 12 from the printer chassis 32. For example, a series or pattern of ridges or bumps can be formed on the ink container 12 to define the engagement feature 38. These patterns of ridges or bumps interlock with corresponding patterns of ridges or bumps forming the engagement features 42 associated with the printer to resist or prevent removal of the pressurized ink container 12.

While the preferred embodiment of the present invention has been described as having raised portions that define the engagement portion 38 on the ink container 12 which selectively engage with depressions or slots that define the engagement portion 42 on the printer 32, this arrangement of engagement portions 38 and 42 can be swapped. For example, the engagement portion 38 on the ink container 12 can be a depression, slot or pattern of depressions which engage with a raised portion, raised ridge or a pattern of raised portions which define the engagement portion 42 associated with the printer 32.

The present invention provides an elegant solution for selectively preventing the removal of ink containers. This solution is economical as well as highly reliable.

What is claimed is:

1. An ink container for providing ink to an ink-jet printer, the ink container including:

an inlet configured for connection to a pressurization source; and an expandable outer shell defined by a wall, the wall expanding upon expansion activation of the pressurization source, the wall of the expandable outer shell having an outer shell engagement feature that is engageable with a corresponding engagement feature of a printer chassis of the ink-jet printer, the expandable outer shell having an unpressurized state, wherein the pressurization source is deactivated and the wall is in an unexpanded position, such that the outer shell engagement feature is disengaged from the corresponding engagement feature of the printer chassis allowing removal of the ink container from the ink-jet printer, and a pressurized state, wherein the pressurization source is activated and the wall is moved to an expanded position, so that the outer shell engagement feature engages the corresponding engagement feature of the printer chassis to resist removal of the ink container from the ink-jet printer.

2. The ink container of claim 1 wherein the wall defining the expandable outer shell forms a pressurizable cavity, and wherein pressurization of the cavity produces movement of the wall of the expandable outer shell to the expanded position causing the outer shell engagement feature to engage the corresponding engagement feature of the printer chassis to prevent removal of the ink container from the ink-jet printer.

3. The ink container of claim 1 wherein the engagement feature of the expandable outer shell is an outer surface of the wall defining the expandable outer shell, and the engagement feature of the printer chassis is an inner printer surface proximate to the outer surface of the wall of the expandable outer shell when the ink container is properly positioned within the printer chassis of the ink-jet printer.

4. The ink container of claim 1 wherein the outer shell engagement feature is a raised portion on an outer surface of the wall defining the expandable outer shell.

5. The ink container of claim 4 wherein the corresponding engagement feature of the printer chassis is a recessed portion on an inner printer surface of the printer chassis, and wherein with the wall of the expandable outer shell in the expanded position the raised portion extends into the recessed portion to resist removal of the ink container from the ink-jet printer.

6. The ink container of claim 1 wherein the wall defining the expandable outer shell is formed from high density polyethylene.

7. The ink container of claim 1 wherein the wall of the expandable outer shell is expandable by selective application of pressurized gas within the expandable outer shell.

8. The ink container of claim 1 further including an ink reservoir for containing ink, the ink reservoir being disposed within the wall defining the expandable outer shell.

9. The ink container of claim 8 wherein the ink reservoir is a flexible container having a fluid outlet fluidically connectable to an ink-jet printhead of the ink-jet printer such that activation of the pressurization source pressurizes the ink reservoir to provide ink to the ink-jet printhead.

10. The ink container of claim 1 wherein the pressurization source is a gas pump external to the expandable outer shell.

11. The ink container of claim 1 wherein the outer shell engagement feature is an outer surface of the wall of the expandable outer shell and the corresponding engagement feature of the printer chassis is an inner surface of the printer chassis, and wherein activation of the pressurization source produces movement of the wall of the expandable outer shell effecting contact between the outer surface and the inner surface which produces a frictional force to resist removal of the ink container from the ink-jet printer.

12. An ink-jet printing system of the type having a pressurized ink container for providing ink to a printhead, the ink-jet printing system comprising:

a source of pressurized gas;

a first engagement feature disposed on a printer chassis of the ink-jet printing system; and a pressurizable ink container fluidically connectable to the printhead and the source of pressurized gas, the pressurizable ink container being defined by a wall having a second engagement feature which corresponds to the first engagement feature of the printer chassis of the ink-jet printing system, wherein selective application of pressurized gas provided by the source of pressurized gas to the pressurizable ink container produces expansion of the pressurizable ink container and movement of the wall, such that the second engagement feature of the wall of the pressurizable ink container engages the first engagement feature of the printer chassis to resist removal of the ink container from the ink-jet printer printing system.

13. The ink-jet printing system of claim 12 wherein the wall defining the pressurizable ink container forms an expandable outer shell defining a pressurizable cavity, and wherein pressurization of the cavity produces movement of the wall of the expandable outer shell causing the second engagement feature to engage the first engagement feature to prevent removal of the ink container from the ink-jet printing system.

14. The ink-jet printing system of claim 13 wherein the pressurizable ink container includes an ink reservoir within the expandable outer shell having a fluid outlet fluidically connectable to the ink-jet printhead, pressurization of the cavity pressurizing the ink reservoir to deliver ink to the printhead.

15. The ink-jet printing system of claim 12 wherein the source of pressurized gas is a pump.

16. The ink-jet printing system of claim 12 wherein the second engagement feature of the pressurizable ink container is an outer surface of the wall defining the pressurizable ink container, and the first engagement feature of the printer chassis is an inner printer surface proximate to the outer surface of the wall of the pressurizable ink container when the ink container is properly positioned within the printer chassis of the ink-jet printing system.

17. The ink-jet printing system of claim 12 wherein the second engagement feature of the pressurizable ink container is a raised portion on an outer surface of the wall of the pressurizable ink container.

18. The ink-jet printing system of claim 17 wherein the first engagement feature of the printer chassis is a recessed portion on an inner printer surface of the printer chassis, and wherein with the wall of the pressurizable ink container moved to an expanded position the raised portion extends into the recessed portion to resist removal of the of the ink container from the ink-jet printing system.

19. A method for preventing removal of an ink container from an ink-jet printing system comprising:

providing a pressurized gas; and expanding the ink container using the pressurized gas to move a wall defining the ink container so as to engage a first engagement feature of the wall of the ink container with a second engagement feature of a printer chassis of the ink-jet printing system to resist removal of the ink container from the ink jet printing system.

20. The method of claim 19 wherein the first engagement feature is a raised portion on an outer surface of the wall of the ink container.

21. The method of claim 20 wherein the second engagement feature of the printer chassis is a recessed portion on an inner printer surface of the printer chassis, and wherein with the wall of the ink container moved to an expanded position the raised portion extends into the recessed portion to resist removal of the of the ink container from the ink-jet printing system.

22. An ink container for providing ink to an ink-jet printer, the ink container including:

an inlet configured for connection to a pressurization source; and an expandable outer shell defined by a wall, the wall expanding upon activation of the pressurization source, wherein an outer surface of the wall of the expandable outer shell is engageable with an inner surface of a printer chassis of the ink-jet printer, the expandable outer shell having an unpressurized state, wherein the pressurization source is deactivated and the wall is in an unexpanded position, such that the outer surface of the wall is disengaged from the inner surface of the printer chassis allowing removal of the ink container from the ink-jet printer, and a pressurized state, wherein the pressurization source is activated and the wall is moved to an expanded position, so that the outer surface of the wall engages the inner surface of the printer chassis to resist removal of the ink container from the ink-jet printer.

* * * * *

UNITED STATES PATENT AND TRADEMARK OFFICE

CERTIFICATE OF CORRECTION

PATENT NO. : 5,917,526
DATED : June 29, 1999
INVENTOR(S) : Rhonda L. Wilson, et al.

It is certified that error appears in the above-identified patent and that said Letters Patent is hereby corrected as shown below:

Column 8,
Line 8, delete second occurrence "of the;"

Signed and Sealed this

Sixth Day of November, 2001

*Attest:*

Nicholas P. Godici

*Attesting Officer*

NICHOLAS P. GODICI
*Acting Director of the United States Patent and Trademark Office*